US006138596A

United States Patent [19]

Gonring et al.

[11] Patent Number: 6,138,596

[45] Date of Patent: Oct. 31, 2000

[54] DAMPED STEERING MECHANISM FOR A WATERCRAFT

[75] Inventors: Steven J. Gonring, Slinger; Kerry J. Treinen, Malone; Brian L. Fisher, Oakfield, all of Wis.

[73] Assignee: Brunswick Corporation, Lake Forest, Ill.

[21] Appl. No.: 09/401,453

[22] Filed: Sep. 22, 1999

[51] Int. Cl.[7] ..... B63H 25/00

[52] U.S. Cl. ..... 114/144 R; 114/150; 180/143; 280/272; 440/60; 440/61

[58] Field of Search ..... 114/144 R, 150, 114/154, 155; 440/58, 59, 60, 61; 180/140–143; 280/272

[56] References Cited

U.S. PATENT DOCUMENTS

| | | | |
|---|---|---|---|
| 4,349,079 | 9/1982 | Leiber | 180/143 |
| 4,669,745 | 6/1987 | Miki et al. | 180/140 |
| 4,736,962 | 4/1988 | Motrenec | 280/272 |
| 5,052,528 | 10/1991 | Sullivan | 188/317 |
| 5,184,702 | 2/1993 | Schulze et al. | 188/282 |
| 5,257,828 | 11/1993 | Miller | 180/79 |
| 5,603,391 | 2/1997 | Class | 188/266 |
| 5,607,035 | 3/1997 | Fulks et al. | 188/322 |

*Primary Examiner*—Jesus D. Sotelo
*Attorney, Agent, or Firm*—William D. Lanyi

[57] ABSTRACT

A hydraulic damper is provided for a steering system, such as that of a boat or watercraft. A manually movable steering mechanism, such as a steering wheel, is connected to a piston and cylinder combination in such a way that rotation of the steering wheel causes relative movement between the piston and cylinder. Hydraulic fluid is disposed within the cylinder in such a way that movement between the cylinder and piston requires the hydraulic fluid to move from one portion of the cylinder to another portion of the cylinder. This fluid movement is conducted through a conduit which can be external to the cylinder or internal to the cylinder and extending through the piston.

19 Claims, 5 Drawing Sheets

DAMPED STEERING MECHANISM FOR A WATERCRAFT

BACKGROUND OF THE INVENTION

1. Field of the Invention

The present invention is generally related to a damping mechanism and, more particularly, to a hydraulically damped mechanism for the steering system of a boat.

2. Description of the Prior Art

Many different types of dampers are known to those skilled in the art. Dampers are typically used to slow the movement of one component in relation to another component. As such, dampers can be used to absorb vibration and other sudden motions.

U.S. Pat. No. 5,257,828, which issued to Miller et al on Nov. 2, 1993, describes a method and apparatus for controlling damping in an electric assist steering system for vehicle yaw rate control. The electric assist steering system comprises a steering torque sensor and an electric assist variable reluctance motor operatively connected to a steering member. A motor control signal is provided in response to a value of the torque signal for control of the assist motor. A motor speed sensor senses speed of the power assist motor and a vehicle speed sensor senses the vehicle speed. A control circuit modifies the motor control signal in response to the sensed motor speed and the sensed vehicle speed signal so as to provide damping that is functionally related to both the motor speed and the vehicle speed for vehicle yaw rate control.

U.S. Pat. No. 4,349,079, which issued to Leiber on Sep. 14, 1982, describes a power steering system for motor vehicles. The system comprises a measurement transducer for the steering direction in close relationship with a piston-cylinder unit which acts simultaneously as the steering damper and as the auxiliary force apparatus. The measurement transducer may also be integrated in the piston of the unit. The control of the hydraulic medium for the piston-cylinder unit takes place preferably via three position valves due to desired throttling in accordance with velocity of the return flow at a particular time.

U.S. Pat. No. 4,736,962, which issued to Motrenec on Apr. 12, 1988, describes a steering stabilizer for vehicles. It is particularly applicable to handlebar controlled vehicles. The stabilizer utilizes a steering column housing having a cylindrical chamber therein. The steering column passes through the actual center of the chamber and hydraulic fluid is held within the chamber. A piston or vane is movable by the turning of the steering column and forces the hydraulic fluid through a restricted passageway whereby the turning of the handlebars is viscously damped.

U.S. Pat. No. 5,052,528, which issued to Sullivan on Oct. 1, 1991, describes a steering knuckle damper. A limited stroke hydraulic actuator which may be located in the structure of a steered axle in a shallow blind bore is disclosed. The piston may be slidably received in the bore and is disposed by an adjustable protrusion secured to the steering system. Displacement of the piston causes hydraulic fluid to flow through an orifice from one side to the other. Resistance to flow of fluid through the orifice damps the motion of the piston and consequently the steering system. A spring returns the piston to an initial position when the steering system is removed from end of travel position.

U.S. Pat. No. 5,603,391, which issued Class et al on Feb. 18, 1997, describes a damper valve for a power steering coupler. The invention relates generally to a damper valve for use on a coupler for hydraulic lines, and, in particular, those which connect a hydraulically actuated servomotor of a servo control to a servo valve. According to the invention, all the elements having a damping effect are arranged captively in the coupler.

U.S. Pat. No. 5,607,035, which issued to Fulks et al on Mar. 4, 1997, describes a hydraulic damper. The damper is intended for use with a motor vehicle and comprises a longitudinally extending tube and a separately formed steering knuckle secured to the tube, wherein the tube is formed from extruded aluminum or aluminum alloy and the steering knuckle is formed from aluminum or aluminum alloy. The steering knuckle includes a tubular portion that overlies and is secured to a portion of the tube through the use of a groove in the tubular portion and a groove in the tube. Adhesive may be injected into the grooves to aid in securing the steering knuckle to the tube.

U.S. Pat. No. 5,184,702, which issued to Schulze et al on Feb. 9, 1993, describes a hydraulic damper. The damper is designed as a piston-cylinder unit. The arrangement has a part forming a vibrational system by means of a spring. Vibrations acting on the damper arrangement are greater attenuated virtually only in the resonant range of the vibrational system because only in this case can vibrations of high amplitude be excited and a high dissipation of energy by way of hydraulic flows in channels and between cylinder chambers takes place.

Newly developed steering systems for boats and other watercraft incorporate electronically controlled signals that eliminate the need for a direct mechanical or hydraulic connection between a steering wheel or other manually movable steering mechanism and the control surfaces which actually implement the steering command. For example, in an electrically controlled boat system incorporating either an outboard motor or a sterndrive, movement of a steering wheel by an operator can create electronic signals that result in the appropriate steering movement of the outboard motor or sterndrive, but the steering wheel is not directly connected to the outboard motor or sterndrive either hydraulically or mechanically. As a result, the operator feels virtually no resistance when the steering wheel is moved. In these types of steering systems, which are commonly referred to as "steer by wire" systems, the lack of feel or resistance in the steering wheel can lead to potentially dangerous circumstances. It would therefore be significantly beneficial if the steering mechanism of a boat or watercraft could be provided with a system that resists an operator's movement of the steering wheel in a manner that is similar to the natural resistance experienced by the operator of a boat or watercraft when a mechanical or hydraulic steering system is used.

SUMMARY OF THE INVENTION

A steering damper made in accordance with the present invention comprises a manually movable steering mechanism, such as a steering wheel, a cylinder, and a quantity of hydraulic fluid disposed within the cylinder. A piston is movable within the cylinder and a conduit connects a first portion of the cylinder in fluid communication with the second portion of the cylinder in order to allow the hydraulic fluid to flow from the first portion to the second portion in response to relative movement between the piston and the cylinder. The manually movable steering mechanisms is connected to a preselected one of the piston and cylinder to cause the relative movement between the piston and cylinder in response to movement of the manually movable steering mechanism.

In a particularly preferred embodiment of the present invention, a valve is disposed in fluid communication with the conduit in order to affect the rate of flow through the conduit between first and second portions of the cylinder. The conduit can be disposed outside the cylinder or, alternatively, can be formed through the piston within the cylinder. In certain embodiments of the present invention, both types of conduits can be used.

The manually movable steering mechanism can be attached in torque transmitting relation with either the cylinder or the piston to cause relative movement between the piston and cylinder in response to movement of the manually movable steering mechanism.

A centering mechanism can be disposed within the cylinder in order to force the piston and the cylinder into a preferred position relative to each other when no manual force is exerted on the manually movable steering mechanism. The centering mechanism can comprise a spring that is disposed within the cylinder and in force transmitting relation with the piston.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
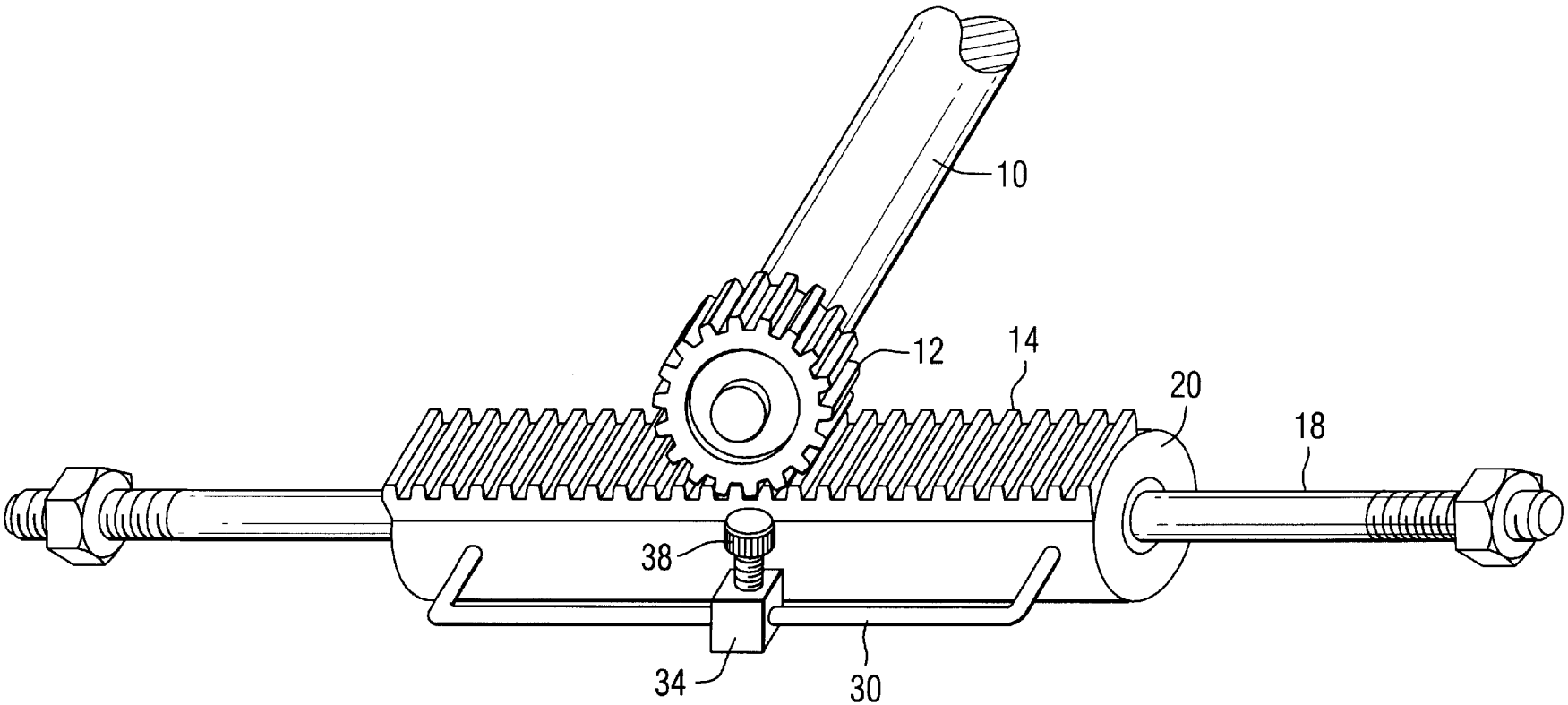
FIG. 1 is a perspective view of a preferred embodiment of the present invention.

Throughout the description of the preferred embodiment of the present invention, like components will be identified by like reference numerals.

With the development of "steer by wire" control systems, a need arises for a method of providing a positive feel at the steering wheel in the absence of steering cables, hydraulic coupling systems, or other types of mechanical connections between the steering wheel and either the outboard motor or sterndrive. Without being coupled, either hydraulically or mechanically, to the outboard motor or sterndrive, the steering wheel would no longer experience the normal resistive forces in a manner similar to known systems. The operator could easily oversteer and experience difficulty in controlling the watercraft during steering maneuvers. Some means is necessary to simulate the feel of existing steering mechanisms, both mechanical and hydraulic, that are well known to those skilled in the art.

Some steering dampers are known to those skilled in the art. These typically include a friction collar which resists rotation of a steering shaft. The amount of friction provided by these systems can be adjusted by turning a set screw that increases or decreases the force between the friction collar and the steering shaft. Unfortunately, friction dampers can become worn and require periodic adjustment.

FIG. 1 shows a perspective view of one embodiment of the present invention. A steering shaft 10 is attached to a pinion gear 12 which, in turn, is disposed in meshing relation with a rack 14. A rod 18 is physically attached to a stationary object (not shown). Cylinder 20 is movable, in a left and right direction in FIG. 1, relative to the stationary shaft 18. A piston (not shown in FIG. 1) is disposed within the cylinder 20 and moves relative to the cylinder 20 in response to rotation of the steering shaft 10. As the steering shaft 10 turns, pinion gear 12 meshes with the teeth of the rack 14 and forces the cylinder 20 to the left or right in response to the rotation of the steering shaft 10. A conduit 30 connects a first portion of the cylinder 20 in fluid communication with a second portion of the cylinder 20 to allow hydraulic fluid to flow to flow from the first portion to the second portion and vice versa. A valve 34 is disposed in fluid communication with the conduit 30 to control the flow of hydraulic through the conduit 30. An adjustment 38 is provided to affect the size of an orifice within the valve 34. By changing the size of the orifice by the adjustment screw 38, more or less resistance can be provided to the flow of hydraulic fluid through the conduit 30. This, in turn, has the effect of changing the resistance of movement of the cylinder 20 relative to the piston and the stationary shaft 18 to which the piston is attached.

Figure 2:
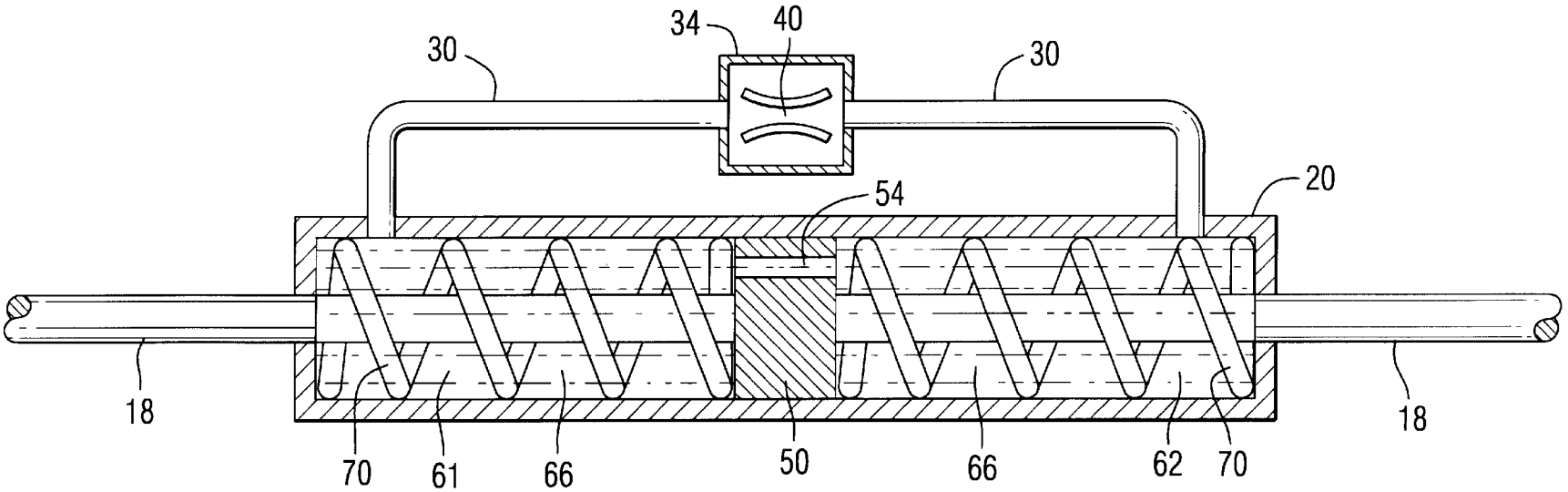
FIG. 2 is a section view of a cylinder showing a centering mechanism disposed therein.

FIG. 2 is a sectional view of a cylinder 20, stationary rod 18, and conduit 30. The valve 34 is shown with a schematically represented orifice 40. Inside the cylinder 20 is a piston 50. As can be seen, the piston 50 has another conduit 54 formed through its axial length. The location of the piston 50 within the cylinder 20 defines a first portion 61 and a second portion 62 of the cylinder 20.

If the cylinder 20 is moved relative to the stationary rod 18, hydraulic fluid 66 must move from one side of the piston 50 to the other side of the piston 50 since the hydraulic fluid is incompressible. In FIG. 2, two conduits are provided for this movement. Some of the hydraulic fluid 62 can move through the conduit 30 from one portion of the cylinder 20 to the other. In addition, hydraulic fluid 62 can also flow through the conduit 54 that is formed through the piston 50.

With continued reference to FIG. 2, a spring mechanism 70 is shown being disposed within the cylinder 20. In the embodiment of FIG. 2, two spring elements are provided, with one spring element being disposed on one side of the piston 50 and the other spring element being disposed on the opposite side of the piston 50. Although the spring mechanism is not required in all embodiments of the present invention, it can serve the purpose of centering the piston 50 within the cylinder 20. Therefore, when all force is removed from the system, the cylinder 20 will return to a central position with respect to the stationary shaft 18 and the piston 50.

Figure 3:
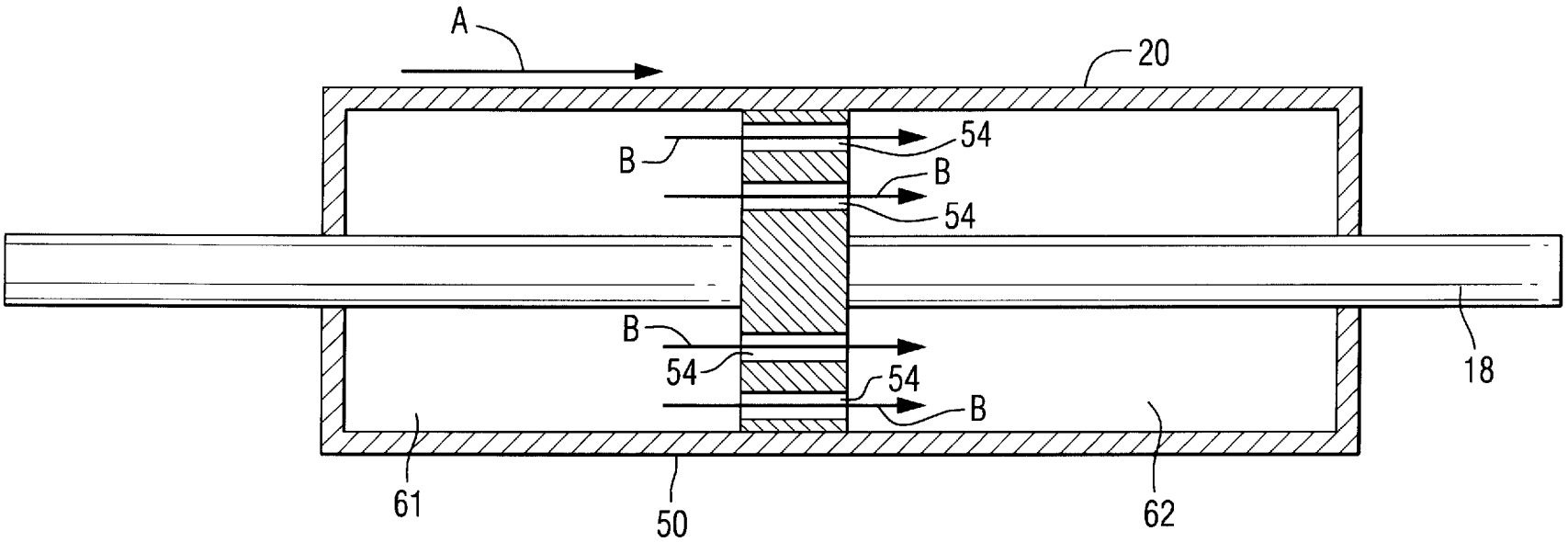
FIG. 3 is a sectional view of a cylinder showing conduits extending axially through a piston.

In FIG. 3, the piston 50 is shown with four individual conduits 54 formed through its axial dimension. If the rod 18 is attached to a stationary object, as described above, movement of the cylinder 20 in the direction represented by arrow A will cause the volume of the first portion 61 to decrease while the second portion 62 increases. This requires hydraulic fluid to flow in the direction represented by arrows B from the first portion 61 to the second portion 62. The flow of the hydraulic fluid through the conduits 54 slows the relative movement between the cylinder 20 and the piston 50. This slowing of the relative movement between the piston and the cylinder provides a natural feel for the boat operator as the steering wheel is turned.

Figure 4:
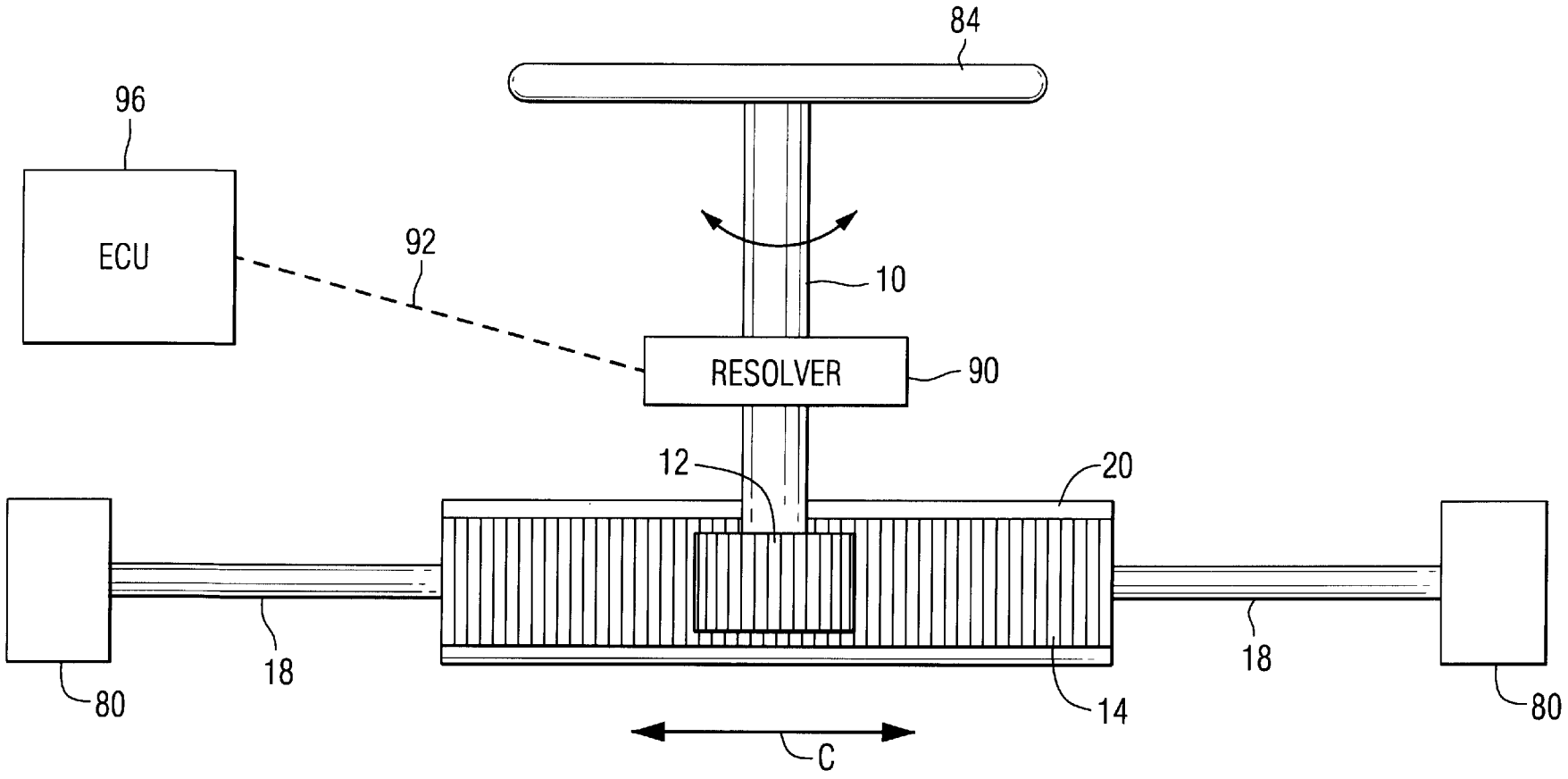
FIG. 4 schematically represents a system incorporating the present invention with a resolver and engine control unit.

FIG. 4 is a schematic representation of a steering shaft 10, its attached pinion gear 12, a rack 14 attached to a cylinder 20, and a stationary rod 18 which is rigidly attached to a stationary object that is schematically represented by the blocks identified by reference numeral 80. A steering wheel 84 is attached to the steering shaft 10 and can be used by a boat operator to rotate the steering shaft 10 and its attached pinion gear 12. This, in turn, causes the rack 14 and its attached cylinder 20 to move either left or right in FIG. 4, as represented by arrows C. Since the piston 50 (not shown in FIG. 4) is stationary and attached to the stationary rod 18, the cylinder 20 moves relative to the piston 50 and hydraulic fluid must pass through the conduits as described above in conjunction with FIGS. 1, 2, and 3.

With continued reference to FIG. 4, a resolver 90 can be attached to the steering shaft 10 to provide a signal, on line 92, to an engine control unit 96. Even though the system in FIG. 4 represents a "steer by wire" system, the cylinder 20 and piston 50 provide a natural resistance to the movement of the steering wheel 84 by the operator.

Figure 5:
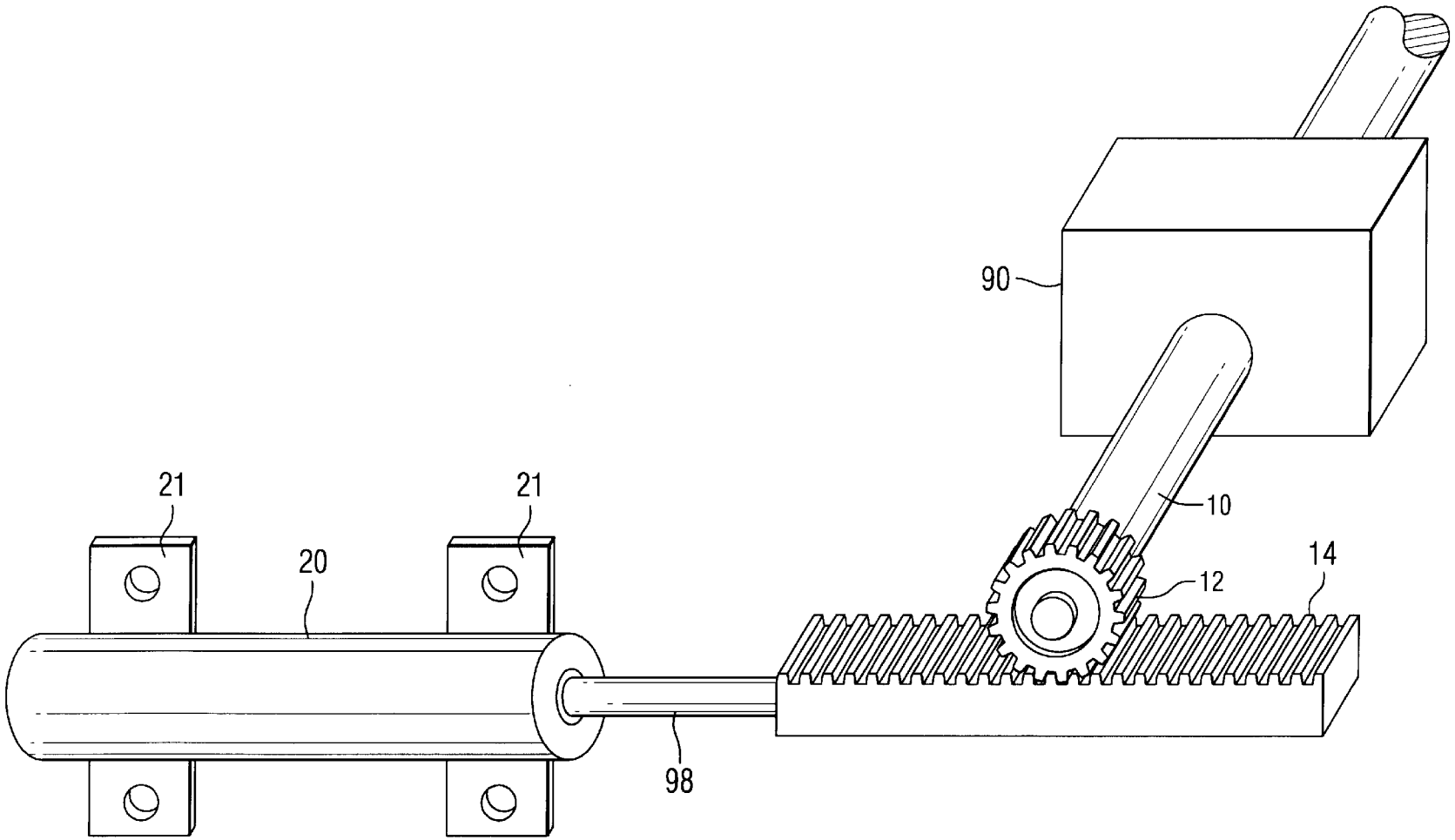
FIG. 5 shows an alternative embodiment of the present invention.

FIG. 5 shows an alternate embodiment of the present invention. In the embodiment of FIG. 5, the cylinder 20 is stationary and attached to a suitable structure through the use of legs 21. A piston 50 (not shown in FIG. 5) is disposed within the cylinder 20 and is movable relative to the cylinder 20. The piston 50 is attached to shaft 98 which, in turn, is attached to rack 14. The steering shaft 10 is attached to a pinion gear 12 which is disposed in meshing relation with the rack 14. As the steering shaft 10 is rotated by a steering wheel 84 (not shown in FIG. 5), the rack 14 is moved to the left or right in FIG. 5. This movement moves the rod 98 which, in turn, moves the piston 50 within the cylinder 20. The same types of conduits, either the conduit 30 described above in conjunction with FIGS. 1 and 2 or the conduits 54 formed through the piston 50, can be used to allow a flow of hydraulic fluid from a first portion of the cylinder 20 to a second portion of the cylinder 20, or vice versa. In the manner described above in FIG. 4, a resolver 90 can be used to provide a signal to an engine control unit 96 (not shown in FIG. 5).

Although the present invention has been described in considerable detail and illustrated to show several embodiments of the present invention, it should be understood that alternative embodiments are also within its scope.

I claim:

1. A steering damper, comprising:

a manually movable steering mechanism;

a cylinder;

a quantity of hydraulic fluid disposed within said cylinder;

a piston movable within said cylinder; and a conduit connecting a first portion of said cylinder in fluid communication with a second portion of said cylinder to allow said hydraulic fluid to flow from said first portion of said cylinder to said second portion of said cylinder in response to relative movement between said piston and said cylinder, said manually movable steering mechanism being connected to a preselected one of said piston and said cylinder to cause said relative movement between said piston and said cylinder in response to movement of said manually movable steering mechanism.

2. The damper of claim 1, further comprising:

a valve disposed in fluid communication with said conduit to affect the rate of flow through said conduit between said first and second portions of said cylinder.

3. The damper of claim 1, wherein:

said conduit is disposed outside said cylinder.

4. The damper of claim 1, wherein:

said conduit is formed through said piston.

5. The damper of claim 1, wherein:

said manually movable steering mechanism is attached in torque transmitting relation with said cylinder.

6. The damper of claim 1, wherein:

said manually movable steering mechanism is attached in torque transmitting relation with said piston.

7. The damper of claim 1, wherein:

said manually movable steering mechanism is a steering wheel of a watercraft.

8. The damper of claim 1, further comprising:

a centering mechanism disposed within said cylinder to force said piston and said cylinder into a preferred position relative to each other when no manual force is exerted on said manually movable steering mechanism.

9. The damper of claim 8, wherein:

said centering mechanism comprises a spring disposed within said cylinder and in force transmitting relation with said piston.

10. A steering damper for a marine propulsion system, comprising:

a manually movable steering mechanism, said manually movable steering mechanism being a steering wheel of a watercraft;

a cylinder;

a quantity of hydraulic fluid disposed within said cylinder;

a piston movable within said cylinder;

a conduit connecting a first portion of said cylinder in fluid communication with a second portion of said cylinder to allow said hydraulic fluid to flow from said first portion of said cylinder to said second portion of said cylinder in response to relative movement between said piston and said cylinder, said manually movable steering mechanism being connected to a preselected one of said piston and said cylinder to cause said relative movement between said piston and said cylinder in response to movement of said manually movable steering mechanism; and a valve disposed in fluid communication with said conduit to affect the rate of flow through said conduit between said first and second portions of said cylinder.

11. The damper of claim 10, wherein:

said conduit is disposed outside said cylinder.

12. The damper of claim 10, wherein:

said conduit is formed through said piston.

13. The damper of claim 10, wherein:

said manually movable steering mechanism is attached in torque transmitting relation with said cylinder.

14. The damper of claim 10, wherein:

said manually movable steering mechanism is attached in torque transmitting relation with said piston.

15. The damper of claim 10, further comprising:

a centering mechanism disposed within said cylinder to force said piston and said cylinder into a preferred position relative to each other when no manual force is exerted on said manually movable steering mechanism.

16. The damper of claim 15, wherein:

said centering mechanism comprises a spring disposed within said cylinder and in force transmitting relation with said piston.

17. A steering damper, comprising:

a manually movable steering mechanism, said manually movable steering mechanism being a steering wheel of a watercraft;

a cylinder, said manually movable steering mechanism being attached in torque transmitting relation with said cylinder;

a quantity of hydraulic fluid disposed within said cylinder;

a piston movable within said cylinder;

a conduit connecting a first portion of said cylinder in fluid communication with a second portion of said cylinder to allow said hydraulic fluid to flow from said first portion of said cylinder to said second portion of said cylinder in response to relative movement between said piston and said cylinder, said conduit being disposed outside said cylinder, said manually movable steering mechanism being connected to a preselected one of said piston and said cylinder to cause said relative movement between said piston and said cylinder in response to movement of said manually movable steering mechanism; and a valve disposed in fluid communication with said conduit to affect the rate of flow through said conduit between said first and second portions of said cylinder.

18. The damper of claim 17, further comprising:

a centering mechanism disposed within said cylinder to force said piston and said cylinder into a preferred position relative to each other when no manual force is exerted on said manually movable steering mechanism.

19. The damper of claim 18, wherein:

said centering mechanism comprises a spring disposed within said cylinder and in force transmitting relation with said piston.

* * * * *